US005927639A

United States Patent [19]

Paepke et al.

[11] Patent Number: 5,927,639

[45] Date of Patent: Jul. 27, 1999

[54] YARN DELIVERY DEVICE

[76] Inventors: Horst Paepke, Hessentorstr. 83; Joachim Paepke, Graf-Wolfeggstr. 32, both of D-72108 Rottenburg, Germany

[21] Appl. No.: 08/774,062

[22] Filed: Dec. 12, 1996

[30] Foreign Application Priority Data

Dec. 12, 1995 [DE] Germany ..... 195 46 404

[51] Int. Cl.[6] ..... B65H 51/00

[52] U.S. Cl. ..... 242/486.7; 242/485.9; 242/486.3

[58] Field of Search ..... 66/132 T; 242/47.01, 242/47.08, 47.09, 484.6, 485.9, 486.3, 486.7

[56] References Cited

U.S. PATENT DOCUMENTS

| | | | |
|---|---|---|---|
| 2,217,716 | 10/1940 | Torrence et al. | 242/47.08 |
| 2,217,717 | 10/1940 | Torrence et al. | 242/47.08 |
| 2,225,641 | 10/1940 | Knebusch | 242/47.08 |
| 2,260,251 | 10/1941 | Jannell | 242/47.08 |
| 2,284,489 | 5/1942 | Kline | 242/47.08 |
| 2,648,117 | 8/1953 | Mayner | 242/47.08 |
| 2,661,522 | 12/1953 | Lowe et al. | 242/47.08 |
| 2,780,347 | 2/1957 | Givens | 242/47.08 |
| 3,567,142 | 3/1971 | Helffer et al. | 242/47.08 |

FOREIGN PATENT DOCUMENTS

| | | |
|---|---|---|
| 556 152 | 4/1957 | Belgium . |
| 91826 | 8/1968 | France . |
| 1574144 | 7/1969 | France . |
| 3501944 | 7/1986 | Germany . |
| 442 267 | 2/1936 | United Kingdom . |

*Primary Examiner*—William Stryjewski

[57] ABSTRACT

A yarn delivery device for textile machines, with at least one drivable yarn storage drum, which is mounted for rotation about an at least approximately vertical axis, and which is fed tangentially via a yarn feed guide element, and from which a yarn is tangentially taken off by means of a yarn takeoff guide element, wherein at least a further yarn storage drum is arranged in series to the first yarn storage drum, and each of the yarn storage drums has at least one turn of yarn.

13 Claims, 4 Drawing Sheets

YARN DELIVERY DEVICE

BACKGROUND OF THE INVENTION

1. Field of the Invention

The invention relates to a yarn delivery device for textile machines, and more particularly to a yarn delivery device with a drivable storage drum.

2. Discussion of Relevant Art

Yarn delivery devices with the abovementioned features of a yarn storage drum are known, for example, from DE-PS 35 01 944 [German Granted Patent]. In this yarn storage drum, the yarn to be processed is taken up tangentially, in multiple wraps, by a yarn takeup region of frustroconical shape, and is then transferred to a yarn storage region which is adjacent to, and of lower conicity than, the yarn takeup region. By means of this shape and the multiple turns, the result is attained that the yarn can, on the one hand, be supplied to the yarn processing location of the textile machine at the peripheral speed of the yarn storage drum, without slip, and on the other hand that the yarn is laid down parallel and adjacent, without overwinding and, because of the conicity of the yarn storage region, makes possible a longitudinal displacement of several yarn turns downwards in the axial direction.

When yarn is taken from a supply bobbin in order to be supplied to a needle for the formation of a stitch, tension peaks can occur which can propagate as far as the stitch formation. Such tension peaks can arise, in the case of multifilament yarns, due for example to filaments projecting outwards from the last layer so that these filaments hook onto the filaments of the yarn to be taken off, in the manner of a hook and loop fastener. The yarn to be taken off can thereby remain held for a short time. The resulting tension peaks are disadvantageous, particularly in stitch formation, since the stitch can be made too small due to such a tension peak, so that the relatively thick head of the needle can no longer pass through. This can lead to a machine stoppage.

A minimal reduction can be provided by the construction of the frustroconical yarn takeup region, and below it a substantially cylindrical yarn takeoff region; but this is however not sufficient in practice to make possible a sufficient decrease in the tension peaks, even when the processing of different materials is required, such as for example cotton, wool, synthetic fiber materials, and the like, so that a reliable and uniform stitch formation of a knitted fabric can be provided.

SUMMARY OF THE INVENTION

The present invention therefore has as its object to provide a yarn delivery device which largely equalizes the tension peaks which arise when the yarn is taken off from a supply bobbin, so that the formation, with a uniform yarn tension, of stitches for a knitted fabric is made possible.

This object is attained according to the invention a yarn delivery device for textile machines with at least one drivable yarn storage drum. The drivable yarn storage drum is mounted for rotation about an at least approximately vertical axis and is fed tangentially via a yarn feed guide element. Yarn is tangentially taken off of the yarn delivery device by means of a yarn takeoff guide element. The first yarn storage drum and at least a further yarn storage drum are provided with at least one yarn turn which passes around the first and the at least further yarn storage drums. The at least further yarn storage drum is positioned ahead of the yarn takeoff guide element and receives yarn from the first yarn storage drum. The first yarn storage drum and the at least further yarn storage drum each has a small-angle frustroconical yarn takeup region that is adjoined by a substantially cylindrical yarn storage region. The first yarn storage drum and the at least further yarn storage drum are arranged in a cascaded manner one behind the other. The small-angle frustroconical yarn takeup region of the at least further yarn storage drum is arranged substantially at the height of the cylindrical yarn storage region of the first yarn storage drum.

A considerable reduction of tension peaks when yarn is taken from the supply bobbin is provided by the arrangement, according to the invention, of at least two yarn storage drums arranged in series, wherein, in the yarn delivery direction, the yarn has at least respectively one turn of yarn per yarn storage drum. By the capstan effect acting on the yarn in the frustroconical region of the yarn storage drum, a reduction can first be achieved, in the case of the first yarn storage drum, which is then amplified by a further reduction of the tension peaks by the second yarn storage drum. In this manner, for example, a yarn tension which is usually given only in grams can amount to 10 g on winding onto the first yarn storage drum, while after takeoff from the second yarn storage drum a yarn tension of about 4 g can be present. Research has shown that a tension of about 6 g is still present between the first and the second yarn storage drums. A further reduction in yarn tension can be provided by the arrangement of a further yarn storage drum in the sequence. The degree of reduction is substantially dependent on the kind of yarn which is to be processed and on the surface of the yarn storage drums, and also on the conicity of the yarn storage takeup region.

It is provided according to an advantageous embodiment of the invention that the yarn storage drum or drums which follow the first yarn storage drum can be driven with an increased rotational speed with respect to the first yarn storage drum. It can thereby be assured that the yarn is drawn from the first yarn storage drum at a certain tension, since the action of the capstan effect can be increased by the increased speed of rotation. The reduction of the tension peaks can thereby be amplified.

According to a further advantageous embodiment of the invention, it is provided that the yarn in the yarn takeoff region of the first yarn storage drum leaves this and is fed tangentially to the yarn takeup region of the second yarn storage drum. A cascaded kind of arrangement of the yarn storage drums relative to each other can thus be advantageously provided and can assure that the yarn taken up on the further yarn drum is separated into individual turns, without the possibility of the yarn being taken up in superposed turns.

According to a further advantageous embodiment of the invention, it is provided that the yarn storage drums which follow one after the other are of identical construction. A cost-effective embodiment of a yarn delivery device can thereby be attained.

Furthermore, according to the invention, an alternative form of embodiment for the reduction of the tension peaks can be provided, in that at least one turn of yarn is laid around at least two yarn storage drums. The axis of rotation of one yarn storage drum then deviates from parallelism with the axis of rotation of the other yarn storage drum. A separation of the yarn wrapping the yarn storage drums is thus made possible, such that a greater or smaller distance between the wraps, which run substantially parallel to each other, can be provided in dependence on the angular position relative to parallelism of the axes. A considerable reduction can be attained with several turns by the capstan principle acting in each wrap, so that a yarn delivery which is nearly free from tension peaks can be provided at the yarn delivery region.

According to a further advantageous embodiment of the invention, it is provided that a first cylindrical storage roller is provided, with the two outer body edges of the cylindrical yarn storage drum and the frustroconical yarn storage drum arranged substantially parallel to each other. A separation of the yarn can thus be achieved on the frustroconical yarn storage drum, and is substantially determined by the degree to which the axis of rotation of the frustroconical yarn storage drum is extended around a parallel rotation axis of the cylindrical yarn storage drum. A precise deflection of the yarn can be achieved due to the cylindrical form of the yarn storage drum. The construction of the second yarn storage drum as a frustroconical yarn storage drum has the advantage that a yarn tension which increases with an increasing number of turns of yarn is prevented, since the path per turn can be kept substantially constant.

According to a further advantageous embodiment of the invention, it is provided that the cylindrical yarn storage drum is driven and that the further yarn storage drum, which advantageously is of frustroconical construction, is entrained. The yarn can thus run uniformly around the yarn storage drums, so that the energy of the tension peaks can be at least partially consumed in the rotation of the frustroconical yarn storage drum. By increasing the number of turns, the reduction of the tension peaks in the yarn can be increased, since the tension peaks die out with an increasing number of yarn turns. Thus a yarn delivery can then be provided which has a constant yarn tension for the preparation of a knitted fabric.

BRIEF DESCRIPTION OF THE DRAWINGS

Preferred embodiments examples of the invention now will be discussed, taken together with accompany drawings in which.

DETAILED DESCRIPTION OF PREFERRED EMBODIMENTS

Figure 1:
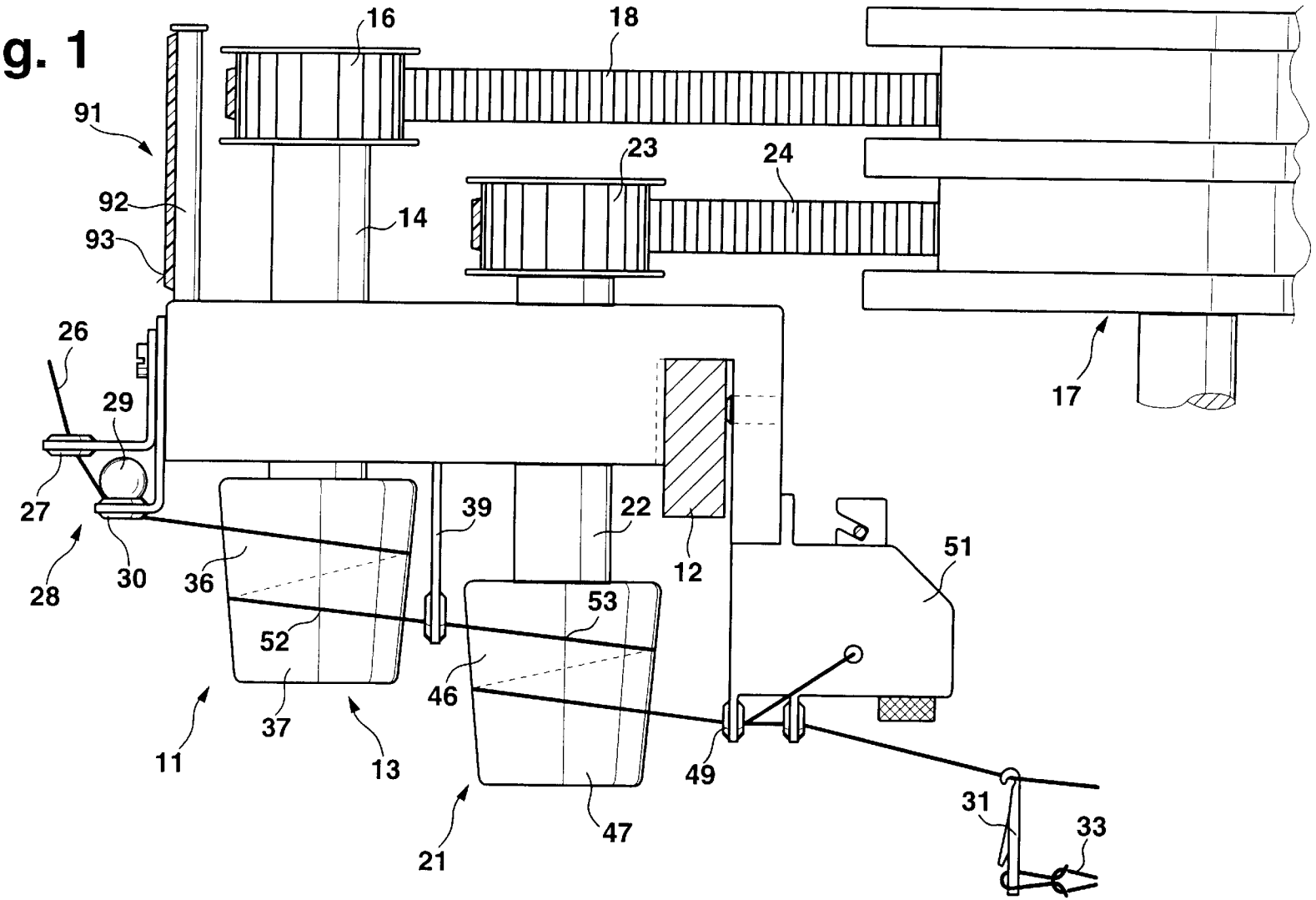
FIG. 1 shows a schematic side view of a yarn delivery device with two yarn storage drums, each having a yarn turn.

A yarn delivery device 11, limited to the portions which are of importance to the invention, is shown in FIG. 1, and is releasably fastened to a machine ring 12 of a textile machine. The yarn delivery device 11 has a first yarn storage drum 13 which is drivingly connected, by means of a drive gearwheel 16 arranged at one end of a shaft 14 and via a toothed belt 18, to a main drive wheel 17. The diameter of the main drive wheel is infinitely adjustable, so that the rotary speed of the yarn storage drum 13 can be matched to the kind of yarn or thread to be processed.

The yarn delivery device 11 has a second yarn storage drum 21, which is arranged later, seen in the yarn delivery direction, and which is likewise drivingly connected, by means of a drive gearwheel 23 arranged at one end of a shaft 22 and via a toothed belt 24, to the main drive wheel 17. The diameter of the main drive wheel 17 is likewise infinitely adjustable for the toothed belt 24, independently of the size of the diameter for the toothed belt 18. Alternatively, it can be provided that still further yarn storage drums are arranged one behind the other, so that a kind of cascaded serial arrangement of the yarn storage drums 13, 21 can be provided. The number of the yarn storage drums which are arranged one behind another is to be chosen in dependence on the effect and the costs, as explained in more detail hereinbelow.

A yarn 26 is taken off a bobbin (not shown). A monofilament or multifilament kind of yarn or thread may be concerned. When taking off multifilament yarns, in particular, a hooking effect or a kind of hook-and-loop effect can arise due to the yarn filaments which stand out from the last layer of the supply bobbin, when the yarn 26 is taken off, so that the yarn to be taken off clings there for a short time, or its takeoff is prevented. Tension peaks thus arise, and propagate as far as the needle 31, so that a stitch 33 can become so small that a head of a needle 31 can no longer be introduced through the stitch 33 in order to grip the yarn 26. This can lead to a stoppage.

The yarn 26, for the reduction of such tension peaks, first passes through a yarn guide eyelet 27 and is then passed through a knot testing element (not shown), to prevent knots passing through and being processed. The yarn is additionally fed to a yarn brake device 28, which is formed by a ball 29 which dances on a horizontally arranged yarn guide eyelet 30. After this braking, which is to prevent the yarn overshooting, the yarn 26 is fed via the yarn guide element 30 to the yarn storage drum 13. The yarn 26 runs tangentially onto a substantially slightly frustroconically formed yarn takeup region 36. The yarn 26, preferably after a complete wrap of the yarn storage drum 13, is then taken off from a yarn takeoff region 37 which is substantially of cylindrical form. The yarn 26 is fed to the second yarn storage drum 21 via a guide element 39 arranged between the yarn storage drum 13 and the yarn storage drum 21, and furthermore runs tangentially onto a substantially slightly frustroconically formed yarn takeup region 46. After a complete wrap of the yarn storage drum 21, the yarn is fed by a cylindrical yarn delivery region 47 to a yarn tension monitoring device 51.

The yarn 26 is then fed to a needle 31, to be knitted. It can likewise be provided that, for example, several wraps are provided in the yarn takeup region 36, 46 and/or in the yarn storage region 37, 47.

The yarn storage drums 13, 21 provided on the yarn delivery device 11, and also their driving parts, such as shafts 14, 22, drive wheels 16, 23 and toothed belts is, 24 can be constructed identically. The yarn storage drum 21 is arranged offset in its height position with respect to the yarn storage drum 13, so that a horizontal yarn section results between a delivery point 52 of the yarn 26 from the yarn storage drum 13 and a takeup point 53 of the yarn 26 onto the yarn storage drum 21. An optimum reduction of the tension peaks in the yarn can thereby result, since the capstan principle is completely valid in both yarn takeup regions 36, 46, and the yarn can be laid without slip on the yarn storage drum 13, 21. On the one hand, yarn 26 can be withdrawn from the bobbin in correspondence with the friction, and on the other hand, tension peaks can be reduced during the takeoff of the yarn from the supply bobbin.

A reduction of the tension peaks in the yarn 26 can already be provided when two identically constructed yarn storage drums 13, 21 are driven at the same rotational speed.

The effect of the reduction of tension peaks can be increased if, for example, with an identical embodiment of the yarn storage drums 13, 21, the rotational speed of the downstream yarn storage drum 21 is at least slightly increased. A further compensation of the tension peaks can be provided by a yarn tension built up between the first yarn storage drum 13 and the second yarn storage drum 21, so that about doubly reduced tension peaks can arrive at the stitch 33. The reduction can be made still greater in dependence on the ratio of the rotational speeds.

Alternatively, it can be provided that the yarn storage drums are differently embodied. Attention must then be paid to the fact that, for example, if the second yarn storage drum 21 is smaller in diameter than the preceding yarn storage drum 13, the rotational speed has to be correspondingly increased. In the converse case the rotational speed is to be reduced when the second yarn storage drum 21 is made larger than the first yarn storage drum 13.

Moreover, it can be provided that the rotational speed of the second yarn storage drum 21 can be made slightly smaller than that of the first yarn storage drum 13. A diminution of the tension peaks can again be thereby attained, since due to the somewhat slacker form of the substantially horizontal yarn path between the first and second yarn storage drums 13, 21, the tension peaks do not pass through, or they do not become transmitted beyond the second yarn storage drum 21, so that a yarn 26 with constant tension can likewise be supplied to the needle 31 for stitch formation. The yarn storage region 37, 47 of the first and second yarn storage drums 13, 21 can advantageously be made longer, so that the yarn 26 is known with certainty to have at least one wrap on the yarn storage drum 21.

The embodiment of the yarn storage drums 13, 21 according to FIG. 1 is not obligatory. Further alternative forms and surface finishes can be provided, which make possible an effect according to the capstan principle when at there is a wrap of least one turn of yarn.

A yarn delivery device is provided by the device according to the invention as shown in FIG. 1, and is one which can be sensitively adjusted for each material to be processed in order to make possible a yarn feed with constant yarn tension, without having tension peaks superimposed on this.

Figure 2:
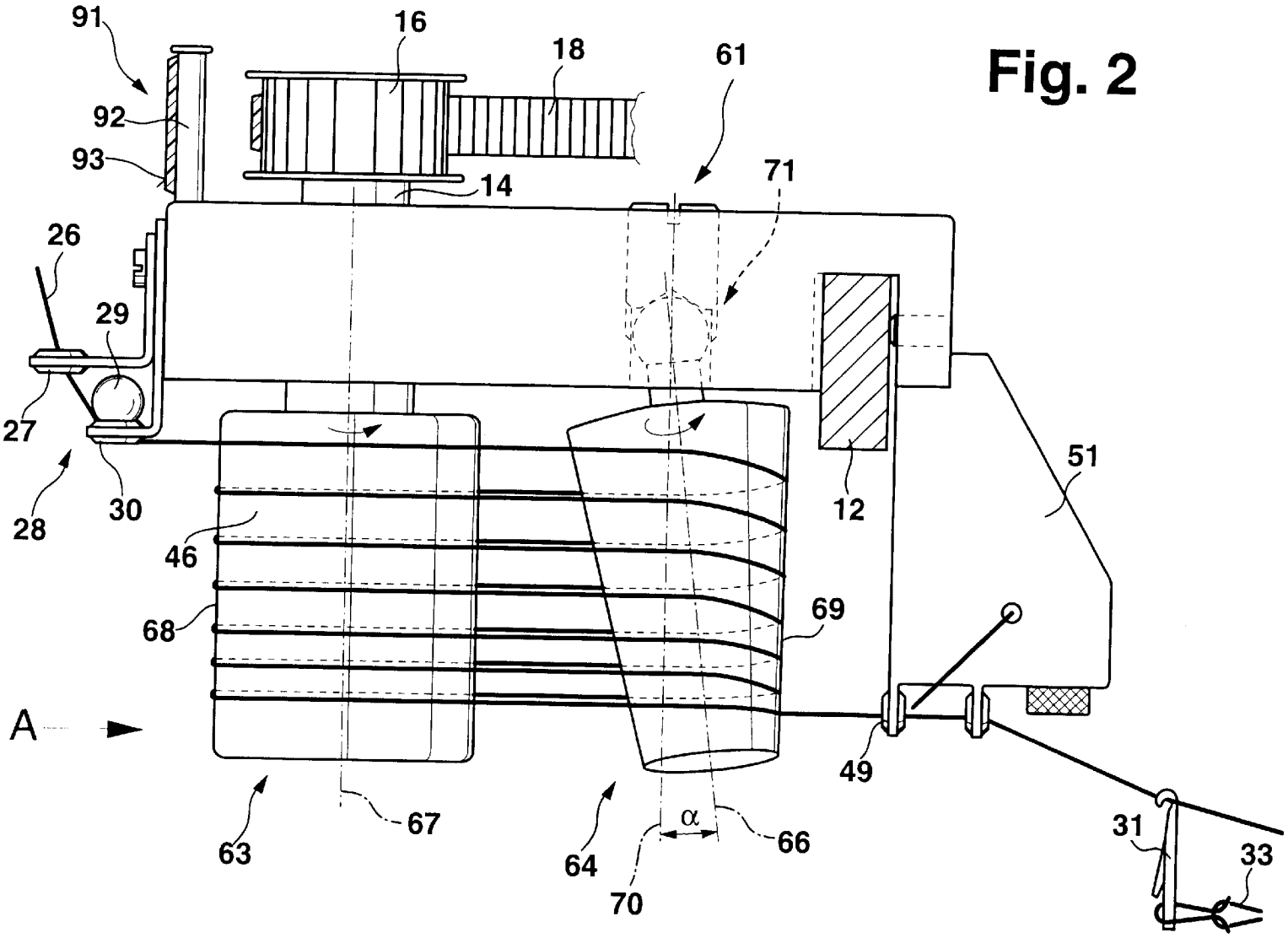
FIG. 2 shows a schematic side view of an alternative embodiment of a yarn delivery device with at least one yarn turn which embraces two yarn storage drums.

An embodiment of a yarn delivery device 61 according to the invention is shown in FIG. 2; the tension peaks likewise arising on takeoff of a yarn 26 can thereby be eliminated or at least greatly reduced.

The yarn delivery device 61 is releasably fastened to a machine ring 12 of a textile machine. The yarn delivery device 61 has a yarn storage drum 63, which is connected to a main drive wheel 17 by means of a toothed belt 18 and a drive gearwheel 16 arranged on a shaft 14.

Analogously to FIG. 1, the yarn 26 is taken off from a supply bobbin and is fed tangentially to the yarn storage drum 63. The yarn 26 runs tangentially onto a yarn takeup region or yarn storage region 46, formed as a cylinder, and is fed downstream to a second yarn storage drum 64. The yarn 26 is then immediately fed back to the yarn storage drum 63, so that a turn is laid around the two yarn storage drums 63, 64. Several turns of yarn around the yarn storage drums 63, 64 are advantageously provided, before the yarn goes past the yarn tension monitoring device 51 and is fed to the needle 31.

The second yarn storage drum 64 can be constructed identically to the first yarn storage drum 63, or can preferably be made in a small-angle frustroconical form, as shown in FIG. 2. The envelope surface can then have an inclination preferably lying between 2° and 5° with respect to an axis of rotation 66. The yarn storage drum 64 is deflected at an angle a from an axis 70 which is axially parallel to the rotation axis 67 of the yarn storage drum 63, so that the two outer edges 68, 69 of the yarn storage drums 63, 64 are substantially parallel to each other. This deflection through the angle a has been found to be advantageous, since the yarn tension of the individual yarn turns can thereby be kept constant.

The yarn storage drum 64 is arranged on a housing of the yarn delivery device 11 via a ball and socket joint 71. This ball and socket joint 71 makes possible an optional deflection which deviates from the axially parallel axis 70, so that the yarn storage drum 64 can be deflected, not only through the angle $\alpha$ but also, according to FIG. 3, by an angle $\beta$. Alternatively it can also be provided that the yarn storage drum 64 can be deflected along a resultant which is the composition of the deflections through the angles $\alpha$ and $\beta$.

Figure 3:
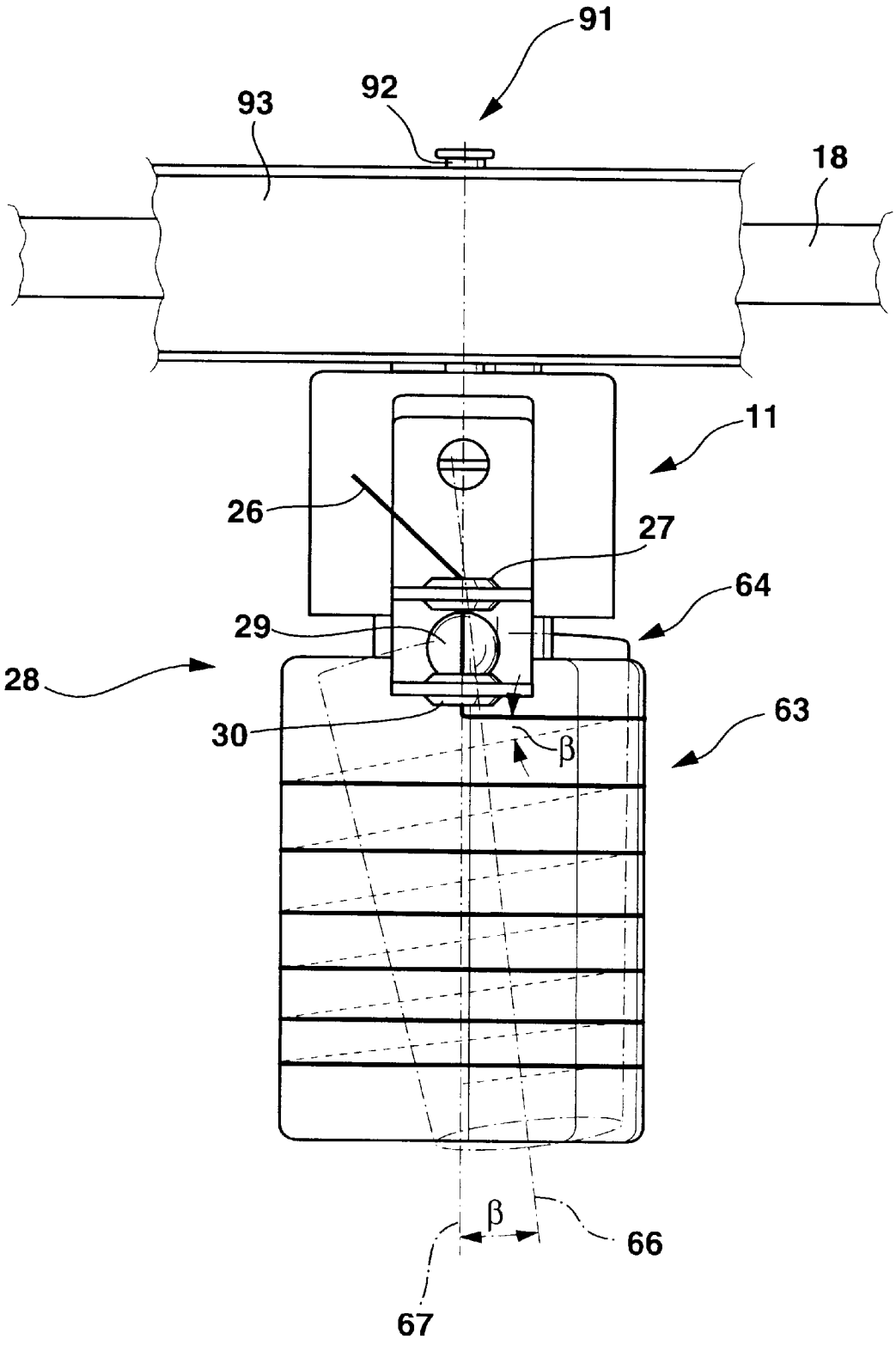
FIG. 3 shows a schematic side view of a yarn delivery device in FIG. 2 according to the arrow A.

The two deflections are however first considered separately, the better to illustrate their effect. The deflection through the angle $\beta$ serves to separate the yarn 26 running onto the yarn storage drums 63, 64. The larger the angle $\beta$, the greater the distance between the individual yarn turns. The angle $\beta$ is shown in FIG. 3, for example, between a section of yarn running onto the yarn storage drum 64 and a section of yarn running off it.

The yarn storage drum 64 is advantageously not driven, but is entrained by the friction of the yarn turns acting on the yarn storage drum 64. For this purpose, the yarn storage drum 64 is advantageously constructed as a hollow cylinder, in order to greatly reduce its inertia. Moreover it is advantageously provided that a surface coating is provided on the yarn storage drums 63, 64, and can advantageously be provided in the form of hard chroming. This represents only one of the possible alternatives.

The tilting through the angle $\alpha$ and through the angle $\beta$ depends on the construction of the second yarn storage drum 64. For example, with a cylindrical roller as a yarn storage drum 64, the deflection through the angle $\beta$ has the effect that the yarn tension steadily increases in the lower yarn turns because of the greater path per turn, and with too great an angle $\beta$ would lead to breakage of the yarn. This means, on the other hand, that the angle $\beta$, and also the angle $\alpha$, has to be matched in dependence on the inclination of the frustroconical body in its tilting.

The tension peaks which appear in the yarn turns can be reduced by the embodiment of an entrained yarn storage drum 64, in that the energy of the tension peaks is converted into the energy for driving the yarn storage drum 64. Furthermore, the tension peaks can be reduced by increasing the number of yarn turns, since the tension peaks die away due to the numerous wraps.

The form of embodiment of a yarn delivery device 61 according to FIG. 2, and also the yarn delivery device 11 of FIG. 1, both have the advantage that they can act bidirectionally and can smooth the tension peaks. This means that tension peaks often also appear during knitting from the stitch side or from the needle 31, and these tension peaks travel in the direction towards the yarn delivery devices 11, 61. By the embodiment of the yarn delivery devices 11, 61 according to the invention, these tension peaks can also be smoothed out, so that smoothing is provided from both the feed side and the delivery side.

With a tilting of the yarn storage drum 64 according to the angles $\alpha$ and $\beta$ as shown in FIGS. 2 and 3, a direction of rotation of the yarn storage drums 63, 64 about the axes of rotation 66, 67 is required according to the arrows in the drawing. Otherwise, the yarn 26 would not run downwards and be separated downwards.

By the possibility of adjusting the yarn storage drum 64, moreover, a yarn delivery device is provided which is adjustable for each yarn and thread material and thus has a flexible field of application.

Alternatively, the yarn storage drum 64 can also be driven. A drive speed is preferably then provided which about corresponds to that of the yarn storage drum 63, or is slightly slower. It is of course also conceivable that the yarn storage drum 64 is driven faster than the yarn storage drum 63, entailing a disadvantageous action.

Moreover, the arrangement of a pair of yarn storage drums according to FIG. 2 is not imperatively required. The arrangement can be provided as an exact mirror image. Furthermore, several yarn storage drums can also be provided, which can be installed in a preferred arrangement on the housing of the yarn delivery device 11, so that the same effect, namely the reduction of tension peaks, can be achieved. Such a pairwise arrangement can also be connected one behind the other in a cascaded manner analogous to FIG. 1. The geometry of the yarn storage drums can be matched in dependence on their arrangement and their number.

Furthermore, a protective device 91 is shown in FIGS. 1–3 which consists of a pin 92 which stands vertically upright, with an externally arranged, revolving protective shield 93. The protective shield 93 can be constructed as a belt, which embraces all the yarn delivery devices arranged on the machine ring 12. The width of the protective shield 93 can be matched to the number of drive wheels 16, 23 or to the height which is thus to be protected. Simple access from the exterior to the drive elements 16, 23, 18 is thus assured.

Figure 4:
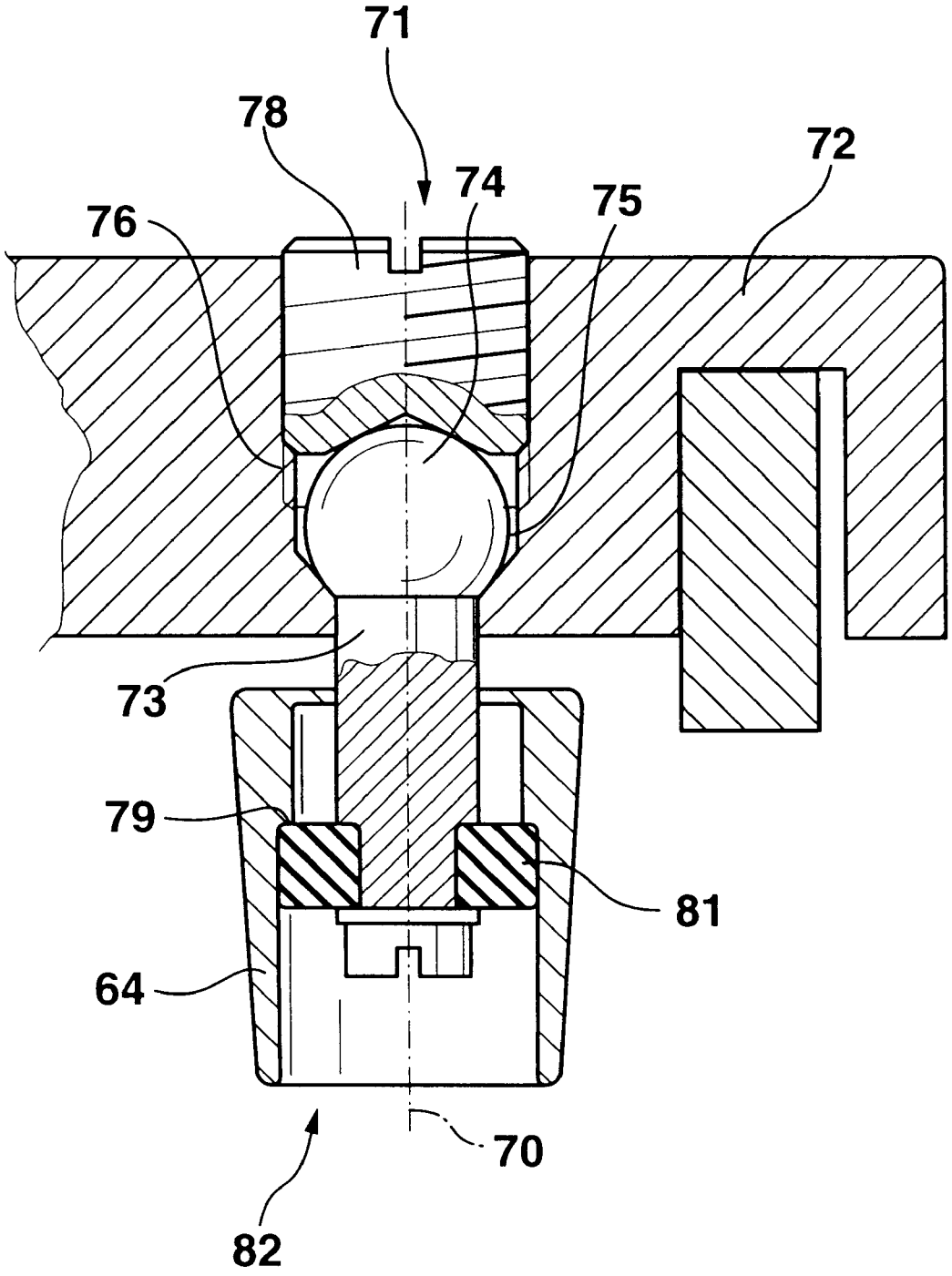
FIG. 4 shows a schematic, enlarged illustration of a joint connection in FIG. 2.

An enlargement of the joint mounting 71 is shown schematically in FIG. 4. A housing 72 of the yarn delivery device 61 has a step bore in which a bolt 73 with a ball head 74 can be inserted. The step bore 75 has, in its section which receives the ball head 74, a thread 76 which receives a clamp piece 78. The bolt 73, which extends downward, can thus be arranged at an angle, in a position which deviates from a longitudinal axis. The longitudinal axis corresponds to the axis 70, so that setting and deflection through the angles $\alpha$ and $\beta$ can be effected.

The yarn storage drum 64 is constructed as a hollow cylindrical body and has a shoulder 79 which is supported on a bearing 81. This, furthermore, is attached by means of a screw connection 82 to the bolt 73, so that the yarn storage drum 64 is mounted to be freely rotatable and can be set in an optional angular position which deviates from the axis 70.

We claim:

1. A yarn delivery device for textile machines with at least one drivable yarn storage drum (13, 63), which is mounted for rotation about an at least approximately vertical axis, and which is fed tangentially via a yarn feed guide element (30), and from which yarn is tangentially taken off by means of a yarn takeoff guide element (49), said at least one drivable yarn storage drum comprising a first yarn storage drum at least a further yarn storage drum (21, 64) which are provided with at least one yarn turn which passes around the first yarn storage drum and the at least further yarn storage drum (13, 63; 21, 64), the at least further yarn storage drum is positioned ahead of the yarn takeoff guide element (49) and receives yarn from the first yarn storage drum, the first yarn storage drum and the at least further yarn storage drum (13, 21) each has a small-angle frustroconical yarn takeup region (36, 46) that is adjoined by a substantially cylindrical yarn storage region (37, 47), the first yarn storage drum and the at least further yarn storage drum (13, 21) are arranged in a cascaded manner one behind the other, and the small-angle frustroconical yarn takeup region (46) of the at least further yarn storage drum (21) is arranged substantially at the height of the cylindrical yarn storage region (37) of the first yarn storage drum (13).

2. A yarn delivery device according to claim 1, characterized in that the first yarn storage drum (13) is drivable.

3. A yarn delivery device according to claim 1, characterized in that the at least further yarn storage drum (21) is drivable.

4. A yarn delivery device according to claim 1, characterized in that the first and the at least further yarn storage drum (13, 21) is drivable.

5. A yarn delivery device according to claim 1, characterized in that the first and the least further yarn storage drum (13, 21) is drivable in common.

6. A yarn delivery device according to claim 1, characterized in that the first yarn storage drum and the at least further yarn storage drum (13, 21) are arranged in a common longitudinal/middle plane of the yarn delivery device (11).

7. A yarn delivery device according to claim 1, characterized in that the first yarn storage drum and the at least further yarn storage drum (13, 21) are substantially identically constructed.

8. A yarn delivery device according to claim 1, characterized in that the yarn (26) is taken off tangentially from the first yarn storage drum (13) and is fed substantially tangentially to the yarn takeup region (46) of the at least further yarn storage drum (21).

9. A yarn delivery device according to claim 1, characterized in that the yarn (26) runs substantially horizontally between the first yarn storage drum (13) and the at least further yarn storage drum (21).

10. A yarn delivery device according to claim 1, characterized in that the yarn guide element (39) is arranged between the first yarn storage drum (13) and the at least further yarn storage drum (21).

11. A yarn delivery device according to claim 1, characterized in that the yarn (26) from the at least further yarn storage drum (21) is taken off substantially tangentially from the yarn storage region (47) thereof.

12. A yarn delivery device according to claim 1, characterized in that the yarn (26) is taken off substantially horizontally with the guide element (49) from the yarn storage region (47) of the at least further yarn drum storage drum (21).

13. A yarn delivery device for textile machines with at least one drivable yarn storage drum (13, 63), which is mounted for rotation about an at least approximately vertical axis, and which is fed tangentially via a yarn feed guide element (30), and from which yarn is tangentially taken off by means of a yarn takeoff guide element (49), said at least one drivable yarn storage drum comprising a first yarn storage drum and at least a further yarn storage drum (21, 64) which are provided with at least one yarn turn which passes around the first yarn storage drum and the at least further yarn storage drum (21, 64), the first yarn storage drum (13) is drivable at a drive speed deviating from that of the at least further yarn storage drum (21, 64), and the further yarn storage drum is driven by yarn from the first yarn storage drum.

* * * * *